US008893404B2

(12) United States Patent
Aveni et al.

(10) Patent No.: US 8,893,404 B2
(45) **Date of Patent: *Nov. 25, 2014**

(54) IMPACT-ATTENUATION SYSTEMS FOR ARTICLES OF FOOTWEAR AND OTHER FOOT-RECEIVING DEVICES

(75) Inventors: Michael A. Aveni, Lake Oswego, OR (US); Patricia L. Smaldone, Portland, OR (US); Fred G. Fagergren, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 358 days.

This patent is subject to a terminal disclaimer.

(21) Appl. No.: 13/353,943

(22) Filed: Jan. 19, 2012

(65) Prior Publication Data

US 2012/0119426 A1 May 17, 2012

Related U.S. Application Data

(60) Continuation of application No. 12/706,289, filed on Feb. 16, 2010, now Pat. No. 8,118,289, which is a division of application No. 11/459,180, filed on Jul. 21, 2006, now Pat. No. 7,685,742.

(51) Int. Cl.

| | |
|---|---|
| ***A43B 13/18*** | (2006.01) |
| ***A43B 13/14*** | (2006.01) |
| ***A43B 21/26*** | (2006.01) |

(52) U.S. Cl.

CPC ..... *A43B 13/183* (2013.01); *A43B 13/18* (2013.01); *A43B 13/14* (2013.01); *A43B 21/26* (2013.01)

USPC ..... 36/27; 36/28; 36/35 R

(58) Field of Classification Search

CPC ..... A43B 13/183; A43B 13/18; A43B 13/14; A43B 13/182; A43B 21/26; A43B 21/30

USPC ..... 36/27, 28, 35 R, 29; 267/141, 145, 14, 267/140.13

See application file for complete search history.

(56) References Cited

U.S. PATENT DOCUMENTS 1,099,180 A * 6/1914 Karacsonyi ..... 36/38
1,110,966 A * 9/1914 Severa ..... 36/38

(Continued)

FOREIGN PATENT DOCUMENTS

DE 10 2005 006267 3/2006

OTHER PUBLICATIONS

Office Action issued in related Chinese Application No. 200780030824.1 on Dec. 30, 2010.

(Continued)

*Primary Examiner* — Ted Kavanaugh
(74) *Attorney, Agent, or Firm* — Banner & Witcoff, Ltd.

(57) ABSTRACT

Impact-attenuation members, e.g., for use in footwear or other foot-receiving devices, include: (a) a first body member having a base region and three (or more) leg portions extending from the base region. A second body member, with similar leg portions, may be arranged facing the first member such that the free ends of the various leg portions lie adjacent one another. A retaining member may extend between and/or at least partially around the body members to at least partially hold them in place with respect to one another. Such impact-attenuation systems may be arranged in the heel (or other portions) of an article of footwear.

19 Claims, 7 Drawing Sheets

(56) References Cited

U.S. PATENT DOCUMENTS

| | | | | | |
|---|---|---|---|---|---|
| 1,510,841 | A | * | 10/1924 | Hanley | 36/38 |
| 2,669,038 | A | * | 2/1954 | De Werth | 36/38 |
| 3,251,145 | A | * | 5/1966 | Mack | 36/7.8 |
| 4,277,055 | A | | 7/1981 | Yamaguchi et al. | |
| 4,673,170 | A | | 6/1987 | Dykema | |
| 4,843,737 | A | | 7/1989 | Vorderer | |
| 5,086,574 | A | | 2/1992 | Bacchiocchi | |
| 5,092,060 | A | | 3/1992 | Frachey et al. | |
| 5,493,791 | A | | 2/1996 | Kramer | |
| 5,643,148 | A | | 7/1997 | Naville | |
| 5,701,685 | A | | 12/1997 | Pezza | |
| 5,832,629 | A | * | 11/1998 | Wen | 36/27 |
| 6,055,747 | A | | 5/2000 | Lombardino | |
| 6,722,058 | B2 | | 4/2004 | Lucas et al. | |
| 7,013,582 | B2 | | 3/2006 | Lucas et al. | |
| 7,685,742 | B2 | | 3/2010 | Aveni et al. | |
| 2003/0126760 | A1 | | 7/2003 | LeVert et al. | |
| 2006/0064900 | A1 | | 3/2006 | Aveni | |
| 2006/0065499 | A1 | | 3/2006 | Smaldone et al. | |
| 2006/0130365 | A1 | | 6/2006 | Sokilowski et al. | |
| 2006/0185191 | A1 | | 8/2006 | Crowley | |

OTHER PUBLICATIONS

International Preliminary Report on Patentability in related International Application No. PCT/US2007/016099, mailed Feb. 5, 2009.
International Search Report in related International Application No. PCT/US2007/016099, mailed Oct. 29, 2007.
Internet printout: http://www.shopadidas.com/product/index—Men's Footwear: Running: a3 Gigaride dated May 15, 2006.
Mar. 12, 2012 Office Action issued in related European Application No. 07796878.2.
Office Action Dated Jul. 16, 2014 for EP Application No. 07796878.2.

* cited by examiner

IMPACT-ATTENUATION SYSTEMS FOR ARTICLES OF FOOTWEAR AND OTHER FOOT-RECEIVING DEVICES

CROSS REFERENCE TO RELATED APPLICATION

This application is a continuation of U.S. patent application Ser. No. 12/706,289 filed Feb. 16, 2010 which is a divisional application of U.S. Pat. No. 7,685,742 issued on Mar. 30, 2010 and originally filed as U.S. application Ser. No. 11/459,180 filed Jul. 21, 2006, the contents of which are incorporated herein by reference.

FIELD OF THE INVENTION

This invention relates generally to impact-attenuation systems, e.g., for use in footwear and other foot-receiving device products, such as in the heel areas of footwear or foot-receiving device products.

BACKGROUND

Conventional articles of athletic footwear have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground or other contact surface reaction forces, the sole structure may provide traction and control foot motions, such as pronation. Accordingly, the upper member and sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces.

SUMMARY

Aspects of this invention relate to impact-attenuation systems, e.g., for use in footwear and other foot-receiving device products, such as in the heel areas of footwear or foot-receiving device products. Such impact-attenuation systems may include: (a) a first body member having a first base region, a first leg portion extending from the first base region, a second leg portion extending from the first base region, and a third leg portion extending from the first base region; and optionally (b) a second body member having a second base region, a fourth leg portion extending from the second base region, a fifth leg portion extending from the second base region, and a sixth leg portion extending from the second base region. When two body members are present, they may be arranged such that the first base region is separated from the second base region and such that a free end of the first leg portion extends toward a free end of the fourth leg portion, a free end of the second leg portion extends toward a free end of the fifth leg portion, and a free end of the third leg portion extends toward a free end of the sixth leg portion. In such impact-attenuating systems, the body members may be arranged such that an impact force on at least one of the first or second base regions presses the free ends of the adjacent leg potions together, and in this manner, attenuates the impact force (e.g., by flexing the leg portions and flattening the body members).

Any structure(s) and/or manner(s) of arranging and/or securing the body members with respect to one another (when plural body members are present) may be used without departing from this invention. For example, one or more retaining members may be provided that extend between and/or at least partially around the first and second body members to at least partially hold them in place with respect to one another. If desired, in at least some structures, portions of the retaining member may extend between (and optionally directly contact) the free ends of the various leg portions to thereby keep the leg portions from directly contacting one another (e.g., the retaining member may be pinched between the free ends of adjacent leg portions when an impact force is applied to the body members).

Still additional aspects of this invention relate to foot-supporting members and/or impact-attenuating systems, e.g., sole structures or portions thereof, such as heel units or the like, that include two or more impact-attenuating members, e.g., of the various types, constructions, and/or relative characteristics described above. If desired, the two or more impact-attenuating members may be engaged with at least one common base member, e.g., to provide an impact-attenuating system or structure with multiple impact-attenuating members that is insertable as a unitary structure into an article of footwear or other foot-receiving device construction.

Other aspects of this invention relate to methods of making footwear or other foot-receiving device products including impact-attenuation members and/or systems in accordance with examples of this invention, e.g., of the various types, constructions, and/or relative characteristics described above. Once incorporated in an article of footwear or other foot-receiving device product, the article of footwear or other product may be used in a known and conventional manner (e.g., for athletic or ambulatory activities), and the impact-attenuation members will attenuate the ground or other contact surface reaction forces (e.g., incident forces from landing a step or jump).

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
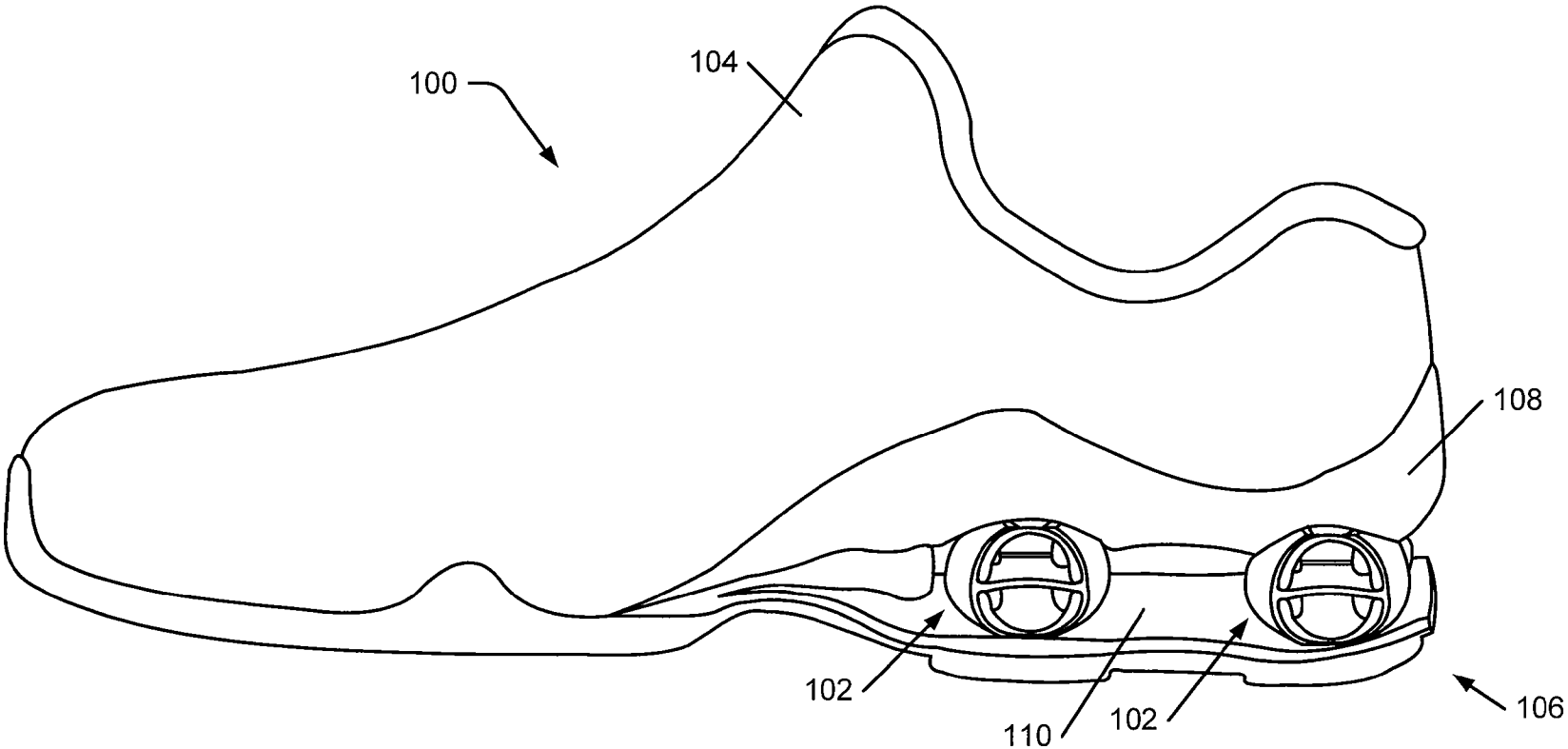
FIG. 1 illustrates an article of footwear including example impact-attenuation members in accordance with this invention.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "side," "front," "rear," "upper," "lower," "vertical," "horizontal," and the like may be used in this specification to describe various example features, elements, and characteristics of the invention, these terms are used herein as a matter of convenience, e.g., based on the example orientations shown in the figures, orientations at rest, and/or orientations during typical use. Nothing in this specification should be construed as requiring a specific three dimensional orientation of structures in order to fall within the scope of this invention.

To assist the reader, this specification is broken into various subsections, as follows: Terms; General Description of Impact-Attenuation Systems and Products Containing Them; Specific Examples of the Invention; and Conclusion.

A. Terms

The following terms may be used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as running shoes, cross training shoes, golf shoes, basketball shoes, tennis shoes, baseball cleats, soccer or football cleats, ski boots, etc.), and the like.

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the types provided in at least some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device and/or landing a jump. "Foot-supporting members" include, but are not limited to, sole members of the type provided in at least some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in at least some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Description of Impact-Attenuation Systems and Products Containing Them In general, aspects of this invention relate to impact-attenuation members, products and systems in which they are used (such as footwear, other foot-receiving devices, heel cage elements, and the like), and methods for including them in such products and systems and using them in such products and systems. These and other aspects and features of the invention are described in more detail below.

1. Impact-Attenuation Members According to the Invention and Foot-Receiving Device Products Including Such Impact-Attenuation Members Impact-attenuating members in accordance with at least some examples of this invention may include: (a) a first body member having a first base region, a first leg portion extending from the first base region, a second leg portion extending from the first base region, and a third leg portion extending from the first base region; and optionally (b) a second body member having a second base region, a fourth leg portion extending from the second base region, a fifth leg portion extending from the second base region, and a sixth leg portion extending from the second base region. When at least two body members are present, the body members may be arranged (and appropriate structures may be provided so as to arrange the body members) such that the first base region is separated from the second base region and such that a free end of the first leg portion extends toward a free end of the fourth leg portion, a free end of the second leg portion extends toward a free end of the fifth leg portion, and a free end of the third leg portion extends toward a free end of the sixth leg portion. The various leg portions of a given body member may extend from their respective base region in different directions, such as in evenly spaced directions around the base region.

Any desired structure(s) and/or manner(s) of arranging the body members with respect to one another may be used without departing from this invention. For example, one or more retaining members may be provided that extend between the first and second body members and at least partially hold the first and second body members in place with respect to one another. In some more specific examples, the retaining member(s) may at least partially extend around an exterior surface of one or more of the body members to thereby at least partially hold them in place with respect to one another and/or with respect to the overall impact-attenuation member structure. Additionally or alternatively, if desired, the retaining member may include one or more base sections that extend between (and optionally directly contact) the free ends of the first and fourth leg portions, between the free ends of the second and fifth leg portions, and/or between the free ends of the third and sixth leg portions, to thereby keep the leg portions from directly contacting one another. In such example structures, the body members may be arranged such that an impact force on at least one of the first or second base regions presses the free ends of the adjacent leg portions together (and pinches the base section(s) therebetween), and in this manner, the impact-attenuating member attenuates the impact force (e.g., by flexing the leg portions and thereby flattening the body members somewhat).

Additional aspects of this invention relate to foot-receiving device products, including articles of footwear, having one or more impact-attenuating member structures of the types described above. More specifically, a foot-receiving device product according to at least some examples of this invention may include: (a) a foot-covering member (such as an upper member for an article of footwear); (b) a foot-supporting member (such as at least a portion of a sole structure for an article of footwear); and (c) an impact-attenuating member, e.g., of the types described above, provided between the foot-covering member and the foot-supporting member. If desired, the impact-attenuating member(s) may be included as part of a midsole structure for an article of footwear, optionally exposed or at least partially exposed in the final footwear product.

Such impact-attenuating members may be used in any desired types of footwear (such as any type of athletic footwear), as well as at any desired locations in a footwear (or other foot-receiving device) structure, such as in a heel portion of an article of footwear or other foot-receiving device. The impact-attenuating member(s) may be arranged such that one body member has its legs extending in a direction toward the outsole member (e.g., generally downward) and/or such that one body member has its legs extending in a direction toward the upper member (e.g., generally upward). Of course, articles of footwear and/or other foot-receiving device products may have any number of impact-attenuating members of the types described above without departing from this invention.

Other examples of foot-receiving devices (e.g., articles of footwear, including athletic footwear) in accordance with examples of this invention may include: (a) a foot-covering member (such as an upper member for an article of footwear); (b) a foot-supporting member (such as a sole structure, including an outsole member); and (c) at least one impact-attenuating member extending between the foot-covering member and the foot-supporting member. The impact-attenuating member(s) may include one or more of the following: (a) an impact-attenuating member that includes a body member having a base region arranged proximate to the foot-covering member, a first leg portion extending from the base region toward the foot-supporting member, a second leg portion extending from the base region toward the foot-supporting member, and a third leg portion extending from the base region toward the foot-supporting member; and/or (b) an impact-attenuating member that includes a body member having a base region arranged proximate to the foot-supporting member, a first leg portion extending from the base region toward the foot-covering member, a second leg portion extending from the base region toward the foot-covering member, and a third leg portion extending from the base region toward the foot-covering member. One or more of the impact-attenuating members may be located in a heel portion of the article of footwear, e.g., as at least a portion of a midsole of the sole structure or other portion of a foot-supporting member structure. When multiple impact-attenuating members are present in a single foot-receiving device product, they may have the same or different structures, and they may be located such that their respective leg portions extend in the same direction (e.g., adjacent one another in the heel-to-toe, lateral-to-medial side, or other directions) and/or such that their respective leg portions extend in opposite directions (e.g., adjacent one another in the heel-to-toe, lateral-to-medial side, or other directions, directly facing one another, etc.).

2. Methods of Making and Using Foot-Receiving Device Products According to Examples of the Invention Additional aspects of this invention relate to methods of making footwear or other foot-receiving device products including impact-attenuation members in accordance with examples of this invention, as well as to methods of using such impact-attenuation members and/or such products, e.g., for attenuating contact surface reaction forces. Such methods may include, for example: (a) providing a foot-covering member, such as an upper member for an article of footwear (e.g., by making it in a conventional manner, obtaining it from another source, etc.); and (b) engaging a foot-supporting member (e.g., a sole structure) with the foot-covering member. As described above, the foot-supporting member (e.g., the sole structure) may include one or more impact-attenuating members of the types described above (e.g., as part of a midsole or other portion of the foot-supporting member).

Another example method in accordance with this invention may include, for example: (a) providing a foot-covering member, such as an upper member for an article of footwear (e.g., by making it in a conventional manner, obtaining it from another source, etc.); (b) engaging a foot-supporting member (e.g., a sole structure) with the foot-covering member; and (c) providing one or more impact-attenuating members of the types described above between the foot-covering member and the foot-supporting member. The impact-attenuating member(s) may be provided individually or independently or as a group (e.g., as a portion of another structure, such as a heel unit, fluid-filled bladder, etc.).

Once incorporated in an article of footwear or other foot-receiving device product, the article of footwear or other product may be used in any desired manner, including in its known and conventional manners, and the impact-attenuation member(s) will attenuate the contact surface reaction forces (e.g., incident forces from landing a step or jump). In some more specific examples, the article of footwear will constitute an athletic or training shoe, e.g., used for running, walking, cross-training, specific sports, etc.

Specific examples of impact-attenuation member structures according to the invention are described in more detail below. The reader should understand that these specific examples are set forth merely to illustrate examples of the invention, and they should not be construed as limiting the invention.

C. Specific Examples of the Invention

The various figures in this application illustrate examples of impact-attenuation members, as well as products and methods according to examples of this invention. When the same reference number appears in more than one drawing, that reference number is used consistently in this specification and the drawings to refer to the same or similar parts throughout. In the description above and that which follows, various connections and/or engagements are set forth between elements in the overall structures. The reader should understand that these connections and/or engagements in general and, unless specified otherwise, may be direct or indirect and that this specification is not intended to be limiting in this respect.

FIG. 1 generally illustrates an example article of footwear 100 (e.g., athletic footwear) including multiple impact-attenuation members 102 in accordance with examples of this invention. The article of footwear 100 includes an upper member 104 and a sole structure 106 engaged with the upper member 104 in any desired manner, including in conventional manners known and used in the art, such as by adhesives or cements; fusing techniques; mechanical connectors; stitching or sewing; and the like. Also, the upper member 104 and sole structure 106 may be made of any desired materials in any desired constructions, including with conventional materials and conventional constructions as are known and used in the art, including, for example, the materials and constructions used for footwear products available from NIKE, Inc. of Beaverton, Oreg. under the "SHOX" brand mark. While the example footwear structure 100 of FIG. 1 illustrates multiple impact-attenuation members 102 generally in the heel area, those skilled in the art will appreciate that such impact-attenuation members 102 may be included at any desired location(s) in any type of footwear 100 or foot-receiving device structure, including, for example, in the forefoot portion. While any number of impact-attenuating members 102 may be included in a footwear structure 100, this illustrated example sole structure 106 includes four individual and distinct impact-attenuating members 102, one generally located and supporting each of the four "corners" of the wearer's heel, namely, the front medial "corner," the front lateral "corner," the rear medial "corner," and the rear lateral "corner." Other impact-attenuating member arrangements also are possible. The individual impact-attenuating members 102 in a given footwear structure 100 may have the same or different sizes, shapes, structures, and/or characteristics without departing from this invention.

While the illustrated footwear structure 100 shows the impact-attenuation members 102 open and exposed at the footwear exterior (e.g., akin to commercial products available from NIKE, Inc., of Beaverton, Oreg. under the "SHOX" brand mark), those skilled in the art will recognize that the impact-attenuation members 102 may be covered or partially covered without departing from this invention (e.g., at least partially embedded within or enclosed by a midsole or other portion of the sole or foot-supporting member structure, at least partially enclosed by a restraining member structure, at least partially engaged with or within a fluid-filled bladder member, etc.).

If desired, the impact-attenuation members 102 may be mounted on and/or between relative rigid surfaces, such as base members 108 and 110. The base members 108 and 110 may be made in any desired shapes and/or constructions, from any desired materials and/or number of independent pieces, without departing from this invention, including in conventional shapes and/or from conventional constructions, materials, and parts known and used in the art (e.g., as known from conventional footwear products available from NIKE, Inc. of Beaverton, Oreg. under the "SHOX" brand mark). As more specific examples, each of the base members 108 and 110 may constitute a one (or more) piece member produced from a rigid plastic material, such as PEBAX® (a polyether-block co-polyamide polymer available from Atofina Corporation of Puteaux, France), one or more members produced from fiber-reinforced plastic or composite materials, one or more members produced from particle-reinforced plastic or composite materials, etc. Metal-containing base members 108 and/or 110 also may be used without departing from this invention. Base members 108 and 110 also may constitute a single, one piece construction, if desired (e.g., a "V" or "C" shaped structure). The base members 108 and 110 may constitute at least a portion of the footwear structure 100, such as part of a footwear midsole member, part of a footwear outsole member, etc. Alternatively, if desired, one or both of the base members 108 and/or 110 may constitute a portion of a unitary structure that supports multiple impact-attenuation members 102 and that is inserted (or insertable) as a unit into the footwear structure.

FIGS. 2A through 2D illustrate features of an example impact-attenuation member 102 in accordance with at least some examples of this invention. In this example arrangement, the impact-attenuation member 102 is made up of three separate parts, namely, a first body member 202 arranged facing downward, a second body member 202 arranged facing upward and opposite the first body member 202, and a retaining member 220 for at least partially arranging and/or holding the two body members 202 in place with respect to one another. Of course, while three separate parts are shown, each of these parts may be constructed from multiple pieces or parts, if desired, without departing from this invention.

Figure 2A:
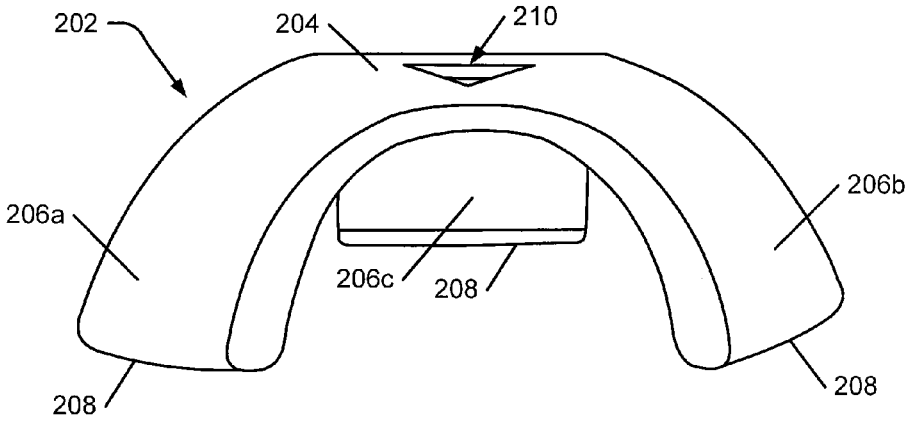
FIGS. 2A through 2D illustrate various parts and features of an example impact-attenuation member in accordance this invention.

FIG. 2A illustrates an example body member 202 in more detail. As shown, this example body member 202 includes a base region 204, which may include a flattened exterior surface (at least somewhat flattened, e.g., to enable more stable and/or secure engagement with another element, such as the base members 108 and/or 110 or other portion of the footwear structure). Other structures to facilitate engagement of the body member 202 with another element (e.g., base members 108 and/or 110) may be provided. The base region 204 may be arranged in a footwear structure (e.g., as shown in FIG. 1) to receive the incident or impact force to be attenuated (e.g., when a footwear wearer lands a step or jump). A plurality of leg portions extend from the base region 204. While any desired number of leg portions may be included as part of a body member 202 without departing from this invention, this illustrated example body member 202 includes three leg portions 206*a*, 206*b*, and 206*c* that are integrally formed with and extend from the base region 204. If desired, the leg portions 206*a*, 206*b*, and 206*c* may be separately formed from the base region 204 and attached thereto in any desired manner, including, for example, through mechanical connectors, retaining member structures, fusing techniques, adhesives, etc.

The body members 202 may be made from any desired materials without departing from this invention. In accordance with at least some examples of this invention, the body members 202 may be made from a rigid material, such as a rigid thermoplastic or other polymeric material, that deforms somewhat under an incident force (e.g., a force from landing a step or jump, etc.) but then returns back to or toward its original size, shape, orientation, and/or configuration when the incident force is removed or relieved. For example, an incident force on the base region 204 (e.g., when a footwear wearer lands a step or jump), which may be oriented in a generally horizontal manner and/or in a direction substantially orthogonal to the expected direction of incident force, may cause the overall body member structure 202 to flatten out somewhat, e.g., as the leg portions 206*a*, 206*b*, and 206*c* flex and the free ends 208 of the leg portions 206*a*, 206*b*, and 206*c* move outward and away from one another. Then, as this incident force is removed or relieved (e.g., when the wearer lifts his/her foot), the leg portions 206*a*, 206*b*, and 206*c* tend to return back to or toward their original positions and/or orientations. As more specific examples, the body members 202 may be constructed as a one (or more) piece member produced from a rigid plastic material, such as PEBAX® (a polyether-block co-polyamide polymer available from Atofina Corporation of Puteaux, France), e.g., by blow molding, injection molding, and/or other processes that are commonly known and used in the art. As still additional examples, the body member(s) 202 may be made from fiber-reinforced plastic or composite materials, particle-reinforced plastic or composite materials, or the like.

In this example impact-attenuation member structure 102, the body members 202 are arranged such that their base regions 204 lie opposite to and face one another. Furthermore, the various leg portions of the body members 202 extend toward one another such that the free ends 208 of the leg portions 206*a*, 206*b*, and 206*c* of one body member 202 terminate proximate to corresponding free ends 208 of the leg portions 206*a*, 206*b*, and 206*c* of the other body member 202. While the free ends 208 of the respective leg portions may directly engage one another (as shown in example structures to be explained in more detail below), in this illustrated example, the opposing free ends 208 of the leg portions 206*a*, 206*b*, and 206*c* are separated from one another by the retaining member 220. More specifically, in this illustrated example structure 102, a central base section 222 of the retaining member 220 extends between and maintains a separation between the free ends 208 of the adjacent leg portions 206*a*, 206*b*, and 206*c*. This base section 222 may extend in a generally horizontal direction in the overall impact-attenuation member structure 102.

As noted above, the free ends 208 of the opposing adjacent leg portions may terminate at or "proximate to" one another (if desired, the free ends 208 may directly contact one another). The term "proximate to," as used herein in this context, means that the free ends 208 are separated by 1.5 inches or less (optionally with other structures located therebetween). In some more specific examples, the free ends 208 may be separated by 1.25 inches or less, 1 inch or less, 0.75 inches or less, 0.5 inches or less, or even 0.25 inches or less. In at least some examples, the free ends 208 will be separated only by the thickness of the retaining member 220 (e.g., each free end 208 will directly contact a surface of the retaining member 220).

The retaining member 220 in this example structure 102, as noted above, includes a base section 222 that extends between the free ends 208 of the adjacent opposing leg portions 206*a*, 206*b*, and 206*c* of the body members 202. This example retaining member 220 continues outside of the body members 202 and extends around at least some portion of an exterior surface of the leg portions 206*a*, 206*b*, and 206*c* of each body member 202 (the term "exterior surface" as used herein in this context, means the convex outer surface of the body member 202, e.g., the exterior in the arrangements illustrated in FIGS. 2B through 2D). While any desired amount or percentage of the exterior surfaces of the body member(s) 202 may be engaged and/or covered by the retaining member 220, in this example structure, at least sufficient portions of the exterior surfaces are engaged and/or covered by the retaining member 220 so as to arrange and/or maintain the body members 202 in their desired positions with respect to one another and/or with respect to the overall impact-attenuation member structure 102. In some more specific examples, at least a majority of the exterior surfaces of the leg portions 206*a*, 206*b*, and 206*c* of the body member(s) may be covered by the retaining member 220 (by a single piece retaining member 220, if desired), and if desired, at least a majority of the exterior surfaces of the body member(s) 202 may be covered by the retaining member 220. In still additional examples, at least 75%, at least 80%, at least 85%, at least 90%, or even at least 95% of the exterior surface of the leg portions 206*a*, 206*b*, and 206*c* and/or the entire body member 202 may be covered by the retaining member 220. If desired, the retaining member 220 may cover all or substantially all (e.g., at least 90% or 95%) of the leg portions and/or even all or substantially all of the body members 202 without departing from this invention. A single piece retaining member 220 may engage both the upper and lower body members 202, as well as multiple legs of each body member 202, as illustrated in the figures.

The retaining member 220 may be made from any suitable or desired material without departing from this invention. In accordance with at least some examples of this invention, the retaining member 220 may be made from a flexible material, such as a polymeric material, that may be pinched together and stretched outward (e.g., pinching and stretching the base portion 222) when the free ends 208 of the leg portions 206*a*, 206*b*, and 206*c* are pressed together and the body members 202 flatten out under an impact-force (e.g., when a wearer lands a step or jump). See arrows 230 in FIGS. 2B through 2D. If desired, the retaining member 220 may be made from a material that returns back to or toward its original size, shape, position, and/or orientation when the incident force is removed or relieved. Optionally, the retaining member 220 may help pull or force the body members 202 back to or toward their original sizes, shapes, positions, and/or orientations when the incident force is removed or relaxed. As some more specific examples, if desired, the retaining member 220 may be made from an at least somewhat flexible and stretchable polymeric material, such as DESMOPAN® (a thermoplastic polyurethane material available from Bayer AG of Leverkusen, Germany).

Figure 2B:
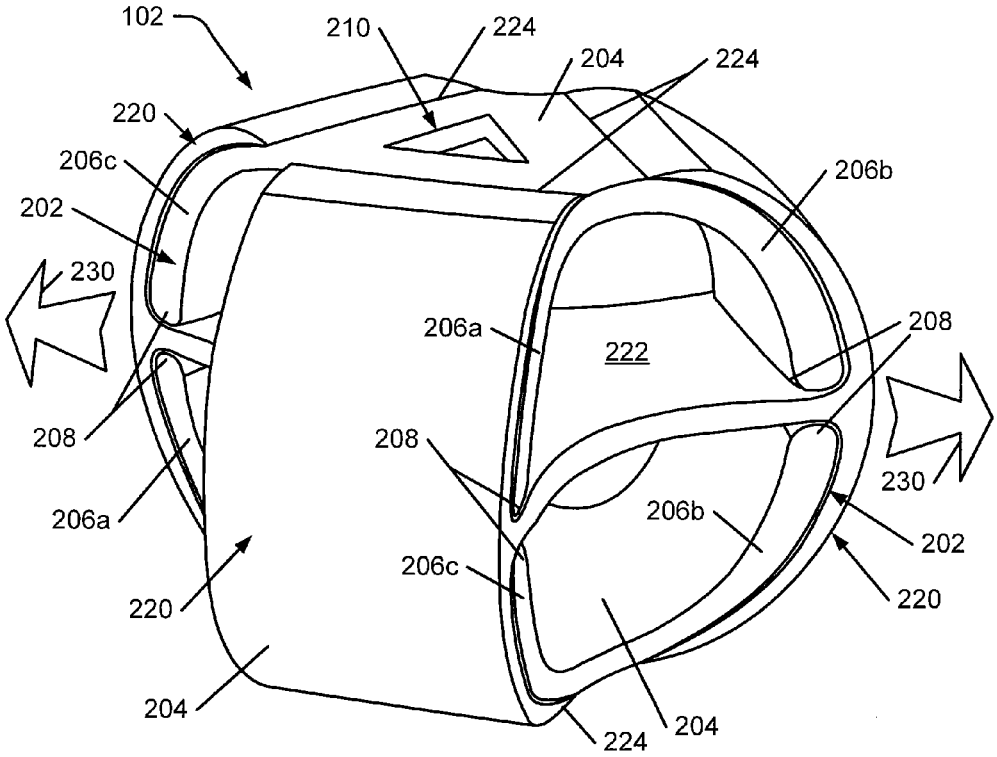
Figure 2C:
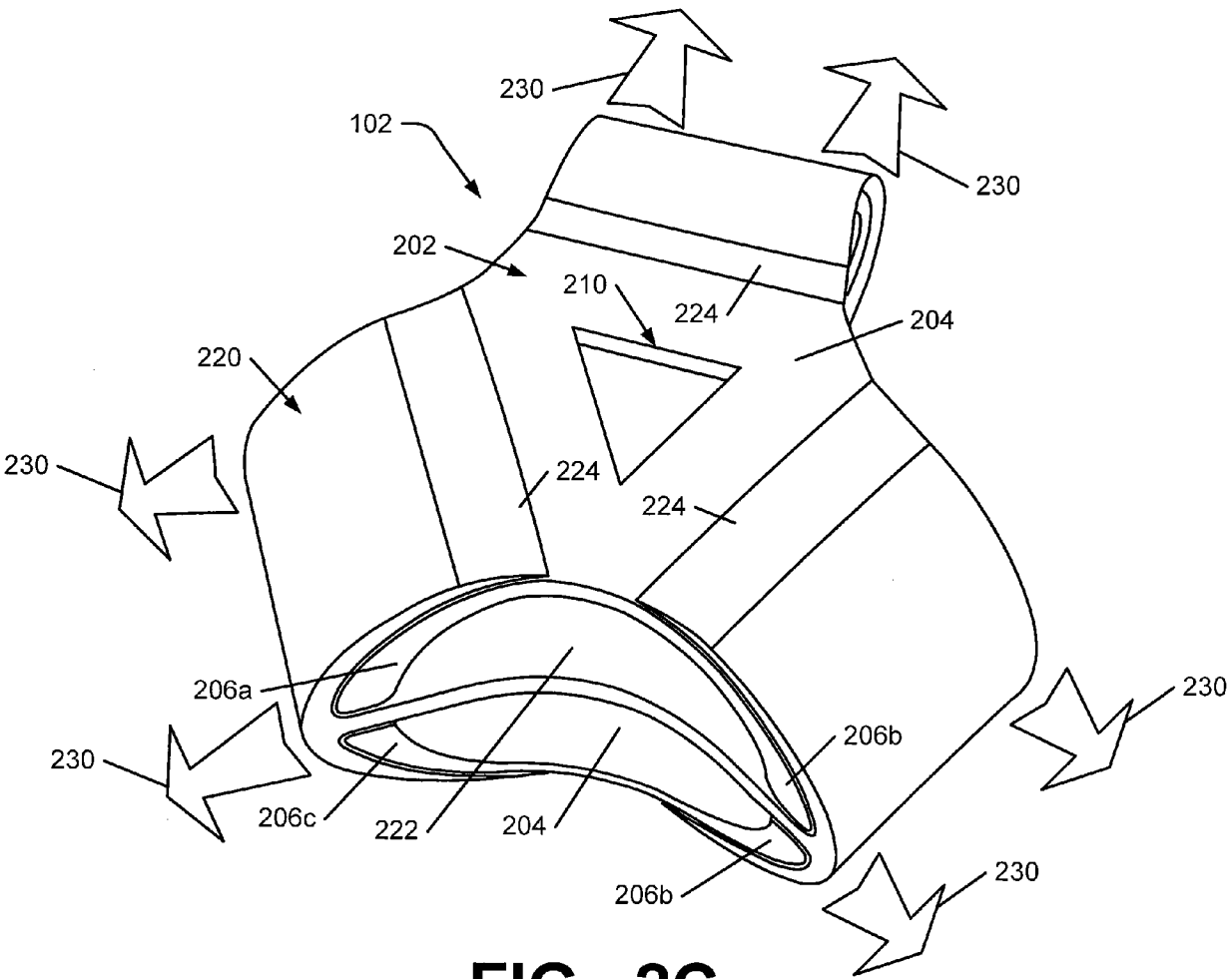
Figure 2D:
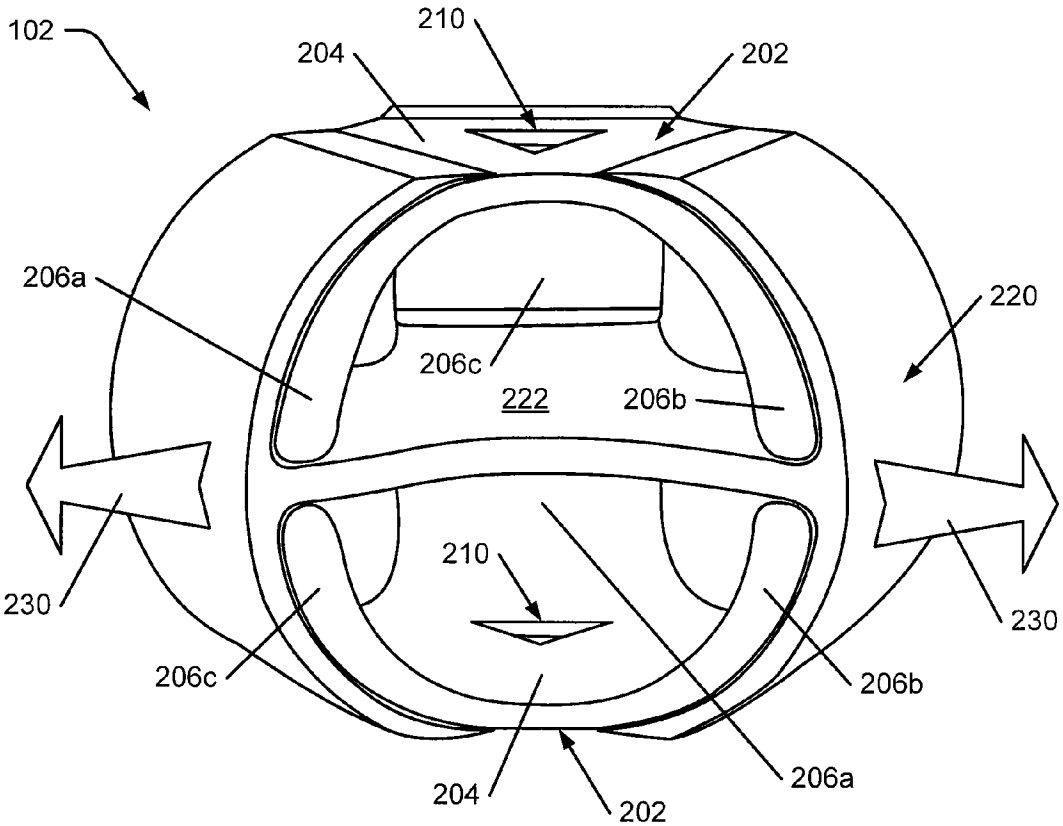

While the retaining member 220 may be made from a single piece of material, as described above, it also may be made from multiple pieces, if desired, in at least some structures according to this invention (e.g., separate individual pieces for each opposing pair of leg portion 206*a*, 206*b*, and 206*c*, optionally with one or more elastic members or other structures connecting the various individual pieces, e.g., making up part of the base section 222 in the interior of the impact-attenuation member structure 102). Also, while the base section 222 is shown as a solid sheet that extends across the entire central region between the body members 202 in this illustrated example structure 102, if desired, one or more openings may be provided in the base section 222 and/or the base section 222 may have a reduced size, without departing from this invention. As another example, if desired, the retaining member 220 may extend between the free ends 208 of the leg portions 206*a*, 206*b*, and 206*c* as shown in FIGS. 2B through 2D and then terminate without providing the complete base section 222. In such structures, if desired, the free ends of the retaining member 220 that extend between the free ends 208 of the leg portions 206*a*, 206*b*, and 206*c* may include some structure for maintaining the retaining member 220 between the free ends 208 and for preventing the free ends of the retaining member 220 from slipping between the free ends 208 of the leg portions 206*a*, 206*b*, and 206*c*, such as a rigid stopper member; extensions of the retaining member material in the vertical direction; a widened, bulbed, or thickened portion; etc.). A wide variety of other structural variations, characteristics, and/or arrangements for the retaining member 220 are possible without departing from this invention.

Various features of the impact-attenuation member 102 may be utilized to set and/or control the impact-attenuation characteristics of the member 102. For example, various features of the body member 202 may be changed or controlled to provide different impact-attenuation characteristics, such as: the type of material; the body member dimensions (e.g., overall height, width, thickness, etc.; leg width, length, thickness, curvature, etc.; base region 204 thickness, width, etc.); opening 210 size; the existence and/or size of other openings in the base region 204 and/or leg portions 206*a*, 206*b*, and/or 206*c*; etc. Also, various features of the retaining member 220 may be changed or controlled to provide different impact-attenuation characteristics, such as: the type of material; the flexibility or "stretchiness" of the material; the elastic characteristics of the material; the degree of tension on the material under neutral conditions; the dimensions of the retaining member 220 (e.g., overall thickness, etc.; base portion 222 thickness, width, etc.); the percentage of open space (if any) in the base portion 222; the extent of exterior surface body member 202 coverage by the retaining member 220; etc.

If desired, the rotational position of the body member 202 may be altered or changed with respect to the top and bottom plates 108 and 110, respectively, e.g., to permit changes to the impact-attenuation characteristics of the overall article of footwear or other foot-receiving device. For example, the positioning and orientation of the window 210 in a footwear or foot-receiving device structure may result in different impact-attenuation characteristics (if desired, the window 210 may be located at a non-central or non-symmetrical location in the body member structure 210, two or more windows 210 may be present, etc.). Any desired structures for allowing access to, changing, and/or releasably securing the body member 202 in place with respect to the top and/or bottom plates 108 and 110, respectively (or other portions of the footwear or foot-receiving device structure), may be used without departing from this invention, including, for example, openable/closable doors or panels, retaining member structures (e.g., tongue and groove type structures, etc.), mechanical connectors, spring-loaded retaining member structures, etc. Also, the body member(s) 202 may be arranged in a footwear or foot-receiving device structure to allow end user access and/or customizability, or they may be permanently mounted in one of plural positions by the manufacturer (who, optionally, may sell the same basic shoe style with different body member 202 orientations to provide a different impact-attenuation "feel" for wearers). When arranged in a movable or customizable manner, the body member 202 may be mounted so as to allow its positioning at a limited number of plural, discrete locations in the overall structure (e.g., similar to locations of numbers on a clock face), or it may be mounted such that it can be fixed at any desired rotational position in the overall structure.

Also, while the downward and upward facing body members 202 are shown having the same general sizes, shapes, and constructions in this illustrated example structure 102, if desired, these body members 202 may differ in an individual impact-attenuation member 102 without departing from this invention, e.g., with one body member 202 being larger or smaller than the other, with longer or shorter legs, with wider or narrower legs, with thicker or thinner legs, with larger or smaller base members, with larger or smaller openings (e.g., in a leg portion 206*a*, 206*b*, and/or 206*c* or base member 204), with an absence of openings, etc. Likewise, the various body members 202 in an individual impact-attenuation member 102 need not have the same impact-attenuation characteristics (e.g., same flex under impact force), even though they may physically appear the same or very similar. Similarly, the various impact-attenuation members 102 and/or portions thereof in an overall footwear or other foot-receiving device structure may have the same or different sizes, shapes, constructions, and/or impact-attenuation characteristics without departing from this invention.

The retaining member 220 may be held together with the body member(s) 202 in any desired manner without departing from this invention. For example, if desired, the material of the retaining member 220 and body members 202, as well as their relative sizes, may be selected such that the direct contact between the major contacting surfaces (the interior surface of retaining member 222 with the exterior surfaces of the leg portions 206*a*, 206*b*, and 206*c*, optionally with the base portion 222 under tension to provide a tight, friction fit) will be sufficient to hold the various parts in place with respect to one another. As another example, if desired, the material of the retaining member 220 may be rigid enough and/or the free ends 224 of the retaining member 220 may sufficiently extend around the body members 202 (e.g., toward the base portions 204) to effectively hold (e.g., "clip" or "clamp") the retaining member 220 around the body members 202 (optionally, if desired, the body member(s) 202 may include a groove, ridge, or other structure into which or around which a portion of the free ends 224 of the retaining structure 220 fits). As yet another alternative, if desired, the base portion 222 of the retaining member 220 may include structures that engage with the free ends 208 of the leg portions 206*a*, 206*b*, and 206*c* (e.g., grooves, ridges, or other structures into which projections on the free ends 208 of the leg portions 206*a*, 206*b*, and 206*c* fit and/or vice versa). Adhesives or cements also may be used to hold retaining member 220 together with the body member(s) 202. Other means of holding the retaining member 220 and the body member(s) 202 in position with respect to one another also may be used without departing from this invention.

Figure 3:
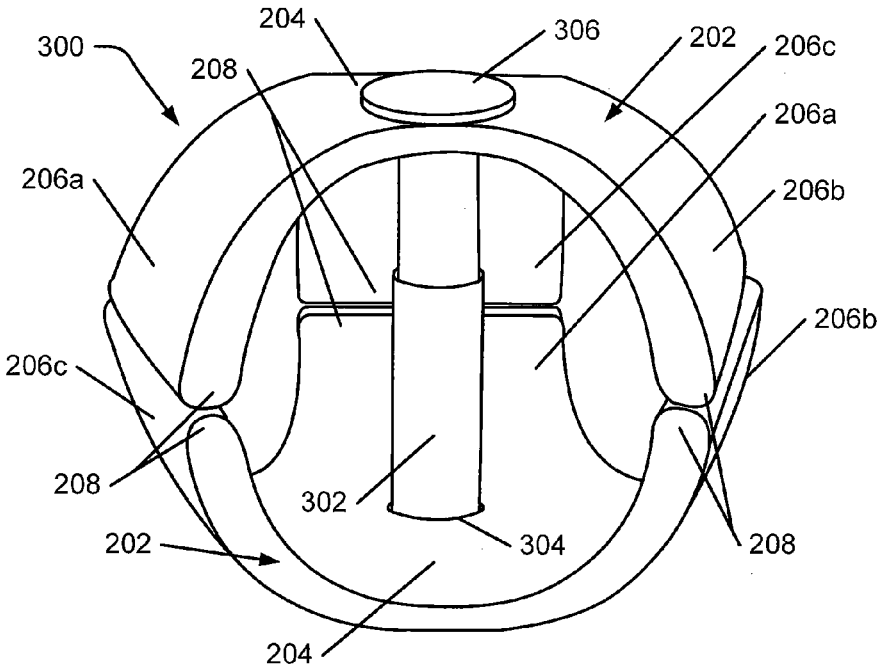
FIG. 3 illustrates another example impact-attenuation member in accordance with this invention.

Still other ways of arranging and/or holding the body members 202 in place with respect to one another are possible without departing from this invention. For example, if desired, the retaining member structure 220 that extends around at least some portion of the exterior surfaces of the leg portions 206*a*, 206*b*, and 206*c* of the body members 202 may be eliminated from the overall impact-attenuation member structure. FIG. 3 illustrates one example arrangement of such an impact-attenuation member 300. In this example structure 300, the opposing free ends 208 of the body members 202 (which may be made from the various materials and/or in the various structures described above) may be held together, optionally in direct contact with one another, by a retaining member 302 that extends through the interior of the overall impact-attenuation member structure 300, e.g., in a generally vertical direction.

A wide variety of structures, arrangements, and/or orientations for the retaining member 302 are possible without departing from this invention. For example, as illustrated in FIG. 3, portions of the retaining member 302 may extend through openings 304 provided in the base regions 204 of the body members 202. A biasing system (e.g., a spring or other structure) provided in or as part of the retaining member 302 may pull the ends 306 of the retaining member 302 toward one another, thereby arranging and holding the free ends 208 of the body members 202 in place with respect to one another. In use, the leg portions 206*a*, 206*b*, and 206*c* of the body members 202 may expand and flatten out under an incident impact force applied to the base regions 204 (e.g., from landing a step or jump, as described above), and the rigid and resilient material characteristics of the body members 202 may force the impact-attenuation member 300 back to or toward its original size, shape, and orientation once the impact force is removed or relieved. In this illustrated example structure 300, the retaining member 302 has a columnar and telescoping structure to allow it to compress under an applied incident force.

Figure 4A:
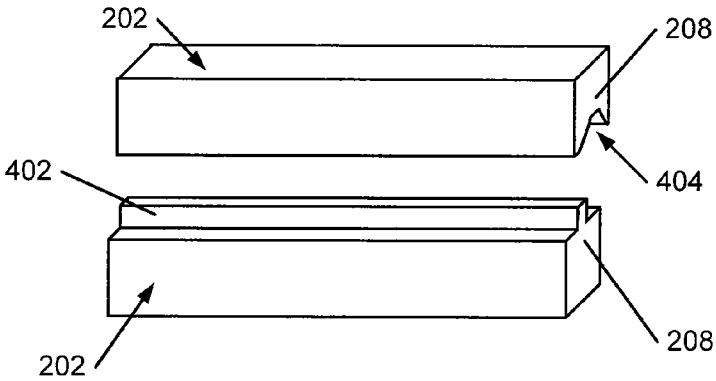
FIGS. 4A through 4D illustrate example structures and arrangements for engaging the free ends of body members with one another in various example impact-attenuation members in accordance with this invention.

Still other ways of arranging and/or holding the body members 202 in place with respect to one another are possible without departing from this invention. For example, in addition to or as an alternative to the retaining member arrangement 302 shown in FIG. 3, the free ends 208 of the leg portions 206*a*, 206*b*, and 206*c* of body members 202 may include structures that help arrange and/or maintain the body members 202 in place with respect to one another. FIGS. 4A through 4D illustrate various examples of such structures (only the free ends 208 of the various body members 202 are illustrated in FIGS. 4A through 4D). As illustrated in FIGS. 4A and 4B, the free ends 208 of the leg portion of at least one of the body members 202 may include retaining structures 402, such as tongues, ridges, or other extending elements, that extend into corresponding and complementary receptacles 404, such as slots, grooves, or recesses, formed in the mating free end 208 of the opposing body member 202. The retaining structures 402 and/or their corresponding receptacles 404 may be shaped (e.g., curved, loosely fit, separated, etc.) to allow some movement of the free ends 208 with respect to one another (e.g., under an applied impact force from landing a step or jump, as the body members 202 flatten out). Of course, a wide variety of structures and arrangements of retaining structures 402 and receptacles 404 may be provided without departing from this invention.

Figure 4C:
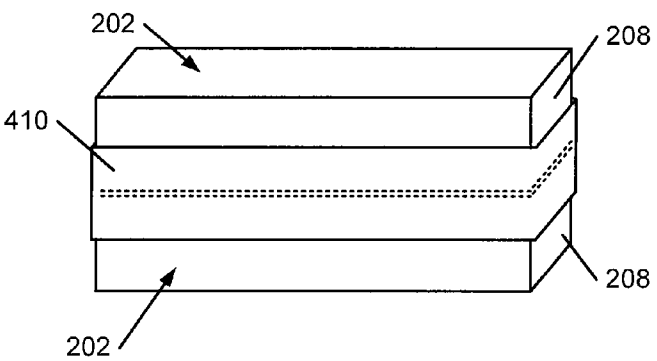
Figure 4B:
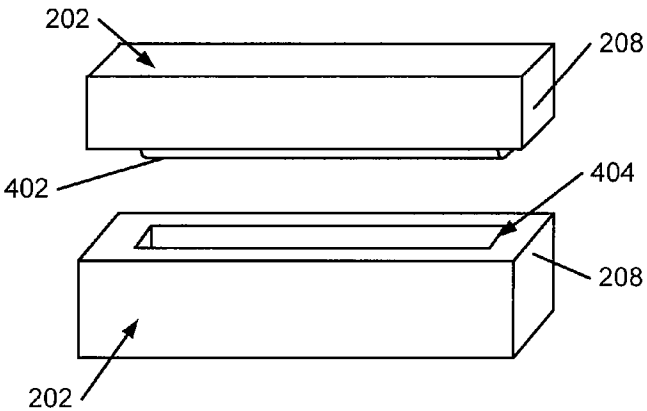

FIG. 4C illustrates another example structure for arranging and/or holding the free ends 208 of the leg portions of the body members 202 in place with respect to one another. In this example, a separate securing element 410 wraps around the free ends 208 and helps hold them in place with respect to one another. The securing element 410 may be engaged with the body members 202 in any desired manner without departing from this invention, including through the use of adhesives, mechanical connectors, etc. As additional examples, if desired, the securing element 410 may be made from an elastic material that is stretched around the free ends 208 and maintained in place via the elastic compressing or retracting force. Also, if desired, the securing element 410 may be made from a somewhat flexible material, e.g., so as to allow some movement of the free ends 208 with respect to one another (e.g., some relative rotation of the free ends 208 under an applied impact force from landing a step or jump as the body members 202 flatten out).

Figure 4D:
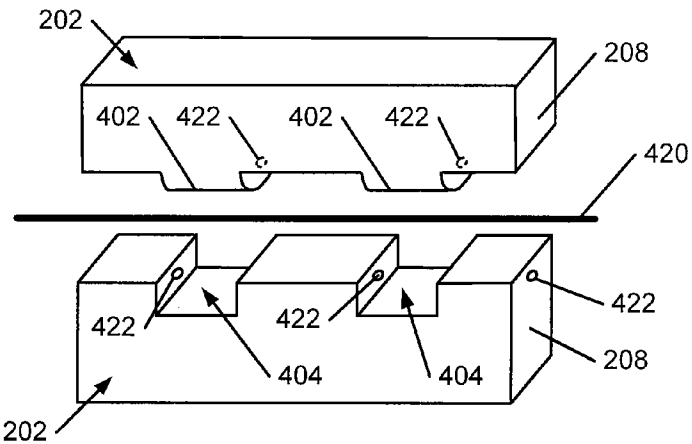

Another example structure for arranging and/or holding the free ends 208 of the leg portions of the body members 202 in place with respect to one another is illustrated in FIG. 4D. Like the structures illustrated in FIGS. 4A and 4B, the free ends 208 of the leg portions of the body members 202 in this example arrangement include retaining structures 402, such as tongues, ridges, or other extending elements, that extend into corresponding and complementary receptacles 404, such as slots, grooves, or recesses, formed in the mating free end of the opposing body member 202. In this example arrangement, however, the free ends 208 of the body members 202 are rotatably engaged together via an axle or hinge element 420 that extends through portions of each body member 202 (e.g., via openings 422). Any desired manner of rotatably engaging the free ends 208 of the body members 202 together may be used without departing from this invention. Also, as described above in conjunction with FIGS. 4A and 4B, the retaining structures 402 and/or their corresponding receptacles 404 may be shaped (e.g., curved, loosely fit, separated, etc.) to allow some movement of the free ends 208 with respect to one another (e.g., under an applied impact force from landing a step or jump). Also, a wide variety of structures and arrangements of retaining structures 402, receptacles 404, and/or axles or hinge members 420 may be provided without departing from this invention.

While FIGS. 4A through 4D illustrate the free ends 208 of body members 202 engaging one another, if desired, similar structures and arrangements may be used to engage the free ends 208 of the body members 202 with the retaining member 220, e.g., in the structures shown in FIGS. 2B through 2D.

Not all individual impact-attenuation members in accordance with examples of this invention require two separate body members 202, e.g., arranged as illustrated in FIGS. 2A through 4D. Rather, if desired, a single piece body member may be provided (e.g., of the composite shape of the two body members 202 illustrated in FIG. 3) without departing from this invention. This single piece body member may be constructed of a material that flexes under an applied incident force (e.g., an impact force from landing a step or jump) to thereby attenuate the impact force. Optionally, if desired, a retaining or covering member may be provided, e.g., to surround or at least partially surround this composite body member, e.g., to keep out dirt, water, or debris; to help with "spring back" of the body member; etc.

Figure 5:
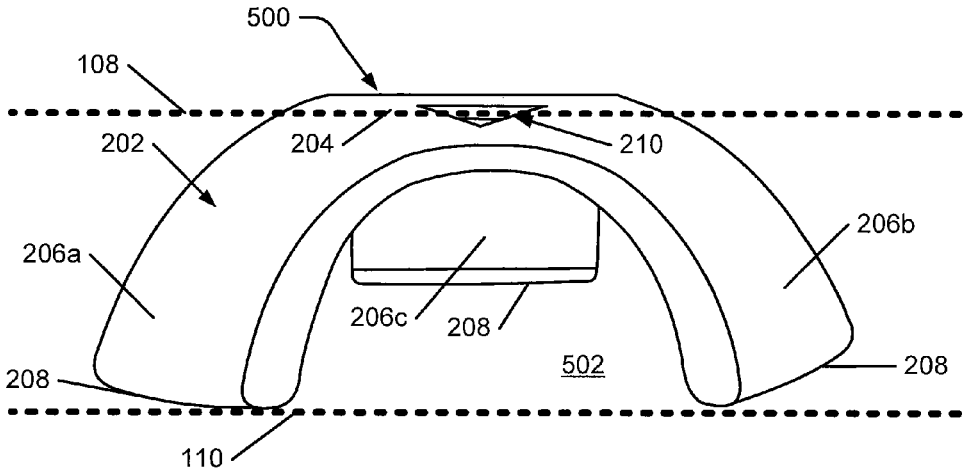
FIGS. 5 and 6 illustrate additional example impact-attenuation members in accordance with this invention.

FIG. 5 illustrates another example impact-attenuation member structure 500 that may be used in accordance with at least some examples of this invention. In this example structure, the impact-attenuation member 500 constitutes a single body member 202 of the type illustrated and described above in conjunction with FIGS. 2A through 2D (accordingly, the same reference numbers are used in FIG. 5 as used in FIGS. 2A through 2D). The body member 202 may be mounted in an article of footwear or other foot-receiving device (or in another structure) at any desired position and in any desired manner, e.g., in the heel area of an article of footwear (or other foot-receiving device), between the base members 108 and 110 from FIG. 1 (and as illustrated in FIG. 5), etc. Rather than having the free ends 208 engage with a retaining member 220 and/or a corresponding free end 208 of another body member 202, the free ends 208 of the body member 202 in this illustrated example structure 500 extend to the base member 110 (or other structure in which it is mounted). Also, as illustrated in FIG. 5, the base portion 204 of the body member 202 lies proximate to the upper base member 108 (or other structure in which it is mounted) such that the single body member 202 extends the entire (or substantially the entire) span between base members 108 and 110.

Figure 6:
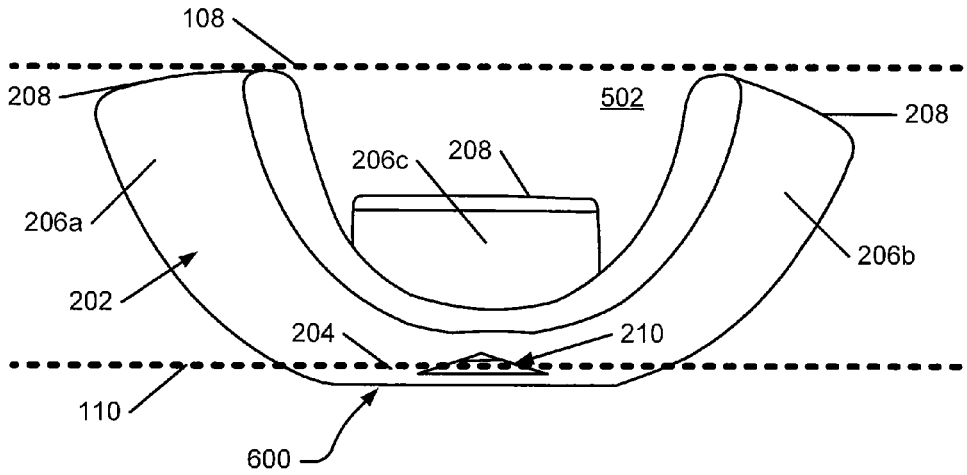

FIG. 6 illustrates another example impact-attenuation member structure 600 that may be used in accordance with at least some examples of this invention. This example impact-attenuation member 600 is similar to that shown in FIG. 5, but it is oriented in a vertically inverted manner as compared to that of FIG. 5. More specifically, this example impact-attenuation member 600 constitutes a single body member 202 of the type illustrated and described above in conjunction with FIGS. 2A through 2D. The body member 202 may be mounted in an article of footwear or other foot-receiving device (or in another structure) at any desired position and in any desired manner, e.g., in the heel area of an article of footwear (or other foot-receiving device), between the base members 108 and 110 from FIG. 1 (and as illustrated in FIG. 6), etc. Rather than having the free ends 208 engage with a retaining member 220 and/or a corresponding free end 208 of another body member 202, the free ends 208 of the body member 202 in this illustrated example structure 600 extend to the base member 108 (or other structure in which it is mounted). Also, as illustrated in FIG. 6, the base portion 204 of the body member 202 lies proximate to the lower base member 110 (or other structure in which it is mounted) such that the single body member 202 extends the entire (or substantially the entire) span between base members 108 and 110.

Also, if desired with respect to the impact-attenuation members 500 and 600 of FIGS. 5 and 6, the rotational position of the body member 202 may be altered or changed with respect to the top and bottom plates 108 and 110, respectively, e.g., to permit changes to the impact-attenuation characteristics of the overall article of footwear or other foot-receiving device. For example, the positioning and orientation of the window 210 in a footwear or foot-receiving device structure may result in different impact-attenuation characteristics (if desired, the window 210 may be located at a non-central or non-symmetrical location in the body member structure 210, two or more windows 210 may be present, etc.). Again, any desired structures for allowing access to, changing, and/or releasably securing the body member 202 in place with respect to the top and/or bottom plates 108 and 110, respectively (or other portions of the footwear or foot-receiving device structure), may be used without departing from this invention, including, for example, openable/closable doors or panels, retaining member structures (e.g., tongue and groove type structures, etc.), mechanical connectors, spring-loaded retaining member structures, etc. Also, the body member(s) 202 may be arranged in a footwear or foot-receiving device structure to allow end user access and/or customizability, or they may be permanently mounted in one of plural positions by the manufacturer (who, optionally, may sell the same basic shoe style with different body member 202 orientations to provide a different impact-attenuation "feel" for wearers). When arranged in a movable or customizable manner, the body member 202 may be mounted so as to allow its positioning at a limited number of plural, discrete locations in the overall structure (e.g., similar to the locations of numbers on a clock face), or it may be mounted such that it can be fixed at any desired rotational position in the overall structure.

Other features may be included with the impact-attenuation members 500 and/or 600 or an article of footwear (or other foot-receiving device structure) or other structure in which they may be mounted. For example, if desired, the materials of the free ends 208 of the leg portions 206*a*, 206*b*, and 206*c* and/or the surface 502 on which they directly contact (e.g., base member 108, base member 110, or another surface) may exhibit a relatively low coefficient of friction with respect to one another so that the free ends 208 of the leg portions 206*a*, 206*b*, and 206*c* can slide outward with respect to one another under an impact force (e.g., as the body member 202 flexes and flattens out under an impact force). Optionally, if desired, the surface 502 may include raised areas, grooves, or the like into which the free ends 208 (or at least portions thereof) are received, e.g., to help maintain the position of the free ends 208 with respect to the surface 502. As another example, if desired, the body member 202 may be covered in some manner, e.g., to prevent dirt, water, debris, etc. from interfering in the interaction between the free ends 208 and the surface(s) 502 on which they directly contact. Multiple impact-attenuation members 500 and/or 600 of the types described above may be included in a single article of footwear or other foot-receiving device product without departing from this invention. Also, if desired, a single footwear or other foot-receiving device product may include both types of impact-attenuation members 500 and/or 600 (and/or the various other impact-attenuation members (e.g., 102, 300) described above in conjunction with FIGS. 1 through 4D) without departing from this invention. Also, any number of leg portions (e.g., 206*a*, etc.) may be included in the impact-attenuation members 500 and/or 600 without departing from this invention.

Impact-attenuation members in accordance with examples of this invention (e.g., 102, 300, 500, and/or 600) may be individually and independently mounted in an article of footwear or other foot-receiving device structure, e.g., during manufacture of the product. Alternatively, if desired, multiple impact-attenuation members (e.g., 102, 300, 500, and/or 600) may be joined together to form a single structure having multiple impact-attenuation members (e.g., as a heel unit, as a fluid-filled bladder member, etc. that contains base members 108 and 110, etc.), and then this single structure may be mounted in an article of footwear or other foot-receiving device structure. The impact-attenuation members (e.g., 102, 300, 500, and/or 600), whether individual or with multiple members joined together as a unit, may be incorporated into an article of footwear or other foot-receiving device product in any desired manner and/or at any desired time in the manufacturing process, including in conventional manners and/or at conventional times as are known and used in the art (e.g., as used in manufacturing various footwear products available from NIKE, Inc. of Beaverton, Oreg. under the "SHOX" and/or "AIR" brand marks). As some more specific examples, the impact-attenuation members (e.g., 102, 300, 500, and/or 600) and/or the structures in which they are contained may be attached to the remainder of a footwear or other foot-receiving device structure using cements or adhesives, mechanical connectors, retaining structures, etc.

Finally, while the impact-attenuation members (e.g., 102, 300, 500, and/or 600) described above are permanently mounted in a footwear or other foot-receiving device structure, this is not a requirement. Rather, if desired, one or more of the impact-attenuating members (or a unitary structure containing multiple impact-attenuating members, such as a heel unit, a fluid-filled bladder, etc.) may be removably mounted in a footwear or other foot-receiving device structure, e.g., to allow interchange and/or replacement of one or more impact-attenuating members (individually or as a unit with multiple impact-attenuating members). Such arrangements allow users, purchasers, retailers, or others to select desired impact-attenuating members to place in a footwear structure, e.g., for customization purposes, for personal preferences, to match desired use or a user's physical characteristics, to repair or replace defective or broken impact-attenuation members, etc.

D. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. An impact-attenuating member, comprising:

a first body member including a first base region, a first leg portion extending from the first base region, a second leg portion extending from the first base region, and a third leg portion extending from the first base region;

a second body member including a second base region, a fourth leg portion extending from the second base region, a fifth leg portion extending from the second base region, and a sixth leg portion extending from the second base region; and means for arranging the first and second body members such that the first base region is separated from the second base region and such that a free end of the first leg portion extends toward a free end of the fourth leg portion, a free end of the second leg portion extends toward a free end of the fifth leg portion, and a free end of the third leg portion extends toward a free end of the sixth leg portion; and wherein the first, second, and third leg portions extend radially outward from the first base region in different directions.

2. An impact-attenuating member according to claim 1, wherein the means for arranging includes a base section that extends between the free ends of the first and fourth leg potions, between the free ends of the second and fifth leg portions, and between the free ends of the third and sixth leg portions.

3. An impact-attenuating member according to claim 2, wherein the base section directly contacts the free ends of the first, second, third, fourth, fifth, and sixth leg portions.

4. An impact-attenuating member according to claim 1, wherein the means for arranging includes a retaining member that extends between the first and second body members and at least partially holds the first and second body members in place with respect to one another.

5. An impact-attenuating member according to claim 4, wherein the retaining member extends through the interior of the impact-attenuating member in a vertical direction.

6. An impact-attenuating member according to claim 4, further comprising a biasing system including in, or as part of, the retaining member.

7. An impact-attenuating member according to claim 4, wherein the retaining member has a columnar and telescoping structure to allow it to compress under an applied incident force.

8. An impact-attenuating member according to claim 4, wherein the retaining member at least partially extends around an exterior surface of the first body member and at least partially extends around an exterior surface of the second body member.

9. An impact-attenuating member according to claim 1, wherein the means for arranging includes a retaining member that at least partially extends around an exterior surface of the first body member and at least partially extends around an exterior surface of the second body member.

10. An impact-attenuating member according to claim 9, wherein the retaining member includes a base section that extends between the free ends of the first and fourth leg potions, between the free ends of the second and fifth leg portions, and between the free ends of the third and sixth leg portions.

11. An impact-attenuating member according to claim 9, wherein the retaining member directly contacts the free ends of the first, second, third, fourth, fifth, and sixth leg portions.

12. An impact-attenuating member according to claim 1, wherein the means for arranging arranges the first and second body members such that an impact force on at least one of the first or second base regions presses the free ends of the first and fourth leg potions together, presses the free ends of the second and fifth leg portions together, and presses the free ends of the third and sixth leg portions together.

13. An impact-attenuating member according to claim 12, wherein the means for arranging includes a base section that is pinched between the free ends of the first and fourth leg potions, between the free ends of the second and fifth leg portions, and between the free ends of the third and sixth leg portions under the impact force.

14. An impact-attenuating member according to claim 1, wherein the means for arranging includes a securing system that at least partially holds the first and second body members in place with respect to one another.

15. An impact-attenuating member according to claim 1, wherein the means for arranging holds the free ends of the first and fourth leg potions together, holds the free ends of the second and fifth leg portions together, and holds the free ends of the third and sixth leg portions together.

16. An article of footwear comprising:

an upper member;

and a sole member engaged with the upper member, wherein the sole member includes a first impact-attenuating member having:

a first body member including a first base region, a first leg portion extending from the first base region, a second leg portion extending from the first base region, and a third leg portion extending from the first base region;

a second body member including a second base region, a fourth leg portion extending from the second base region, a fifth leg portion extending from the second base region, and a sixth leg portion extending from the second base region; and means for arranging the first and second body members such that the first base region is separated from the second base region and such that a free end of the first leg portion extends toward a free end of the fourth leg portion, a free end of the second leg portion extends toward a free end of the fifth leg portion, and a free end of the third leg portion extends toward a free end of the sixth leg portion; and wherein the first, second, and third leg portions extend radially outward from the first base region in different directions.

17. The article of footwear of claim 16, wherein the means for arranging includes a retaining member that extends between the first and second body members and at least partially holds the first and second body members in place with respect to one another.

18. The article of footwear of claim 17, further comprising a biasing system including in, or as part of, the retaining member.

19. The article of footwear of claim 16, wherein the means for arranging includes a securing system that at least partially holds the first and second body members in place with respect to one another.

* * * * *